United States Patent [19]

Ukon

[11] Patent Number: 4,955,733

[45] Date of Patent: Sep. 11, 1990

[54] PRINTING APPARATUS WITH EXPANDED PITCH MODE AND UNDERLINING

[75] Inventor: Tsutomu Ukon, Kuwana, Japan

[73] Assignee: Brother Kogyo Kabushiki Kaisha, Aichi, Japan

[21] Appl. No.: 319,701

[22] Filed: Mar. 7, 1989

[30] Foreign Application Priority Data

Mar. 14, 1988 [JP] Japan ..... 63-61336

[51] Int. Cl.[5] ..... B41J 29/26

[52] U.S. Cl. ..... 400/17; 400/76; 400/303

[58] Field of Search ..... 400/16, 17, 22, 303, 400/76

[56] References Cited

U.S. PATENT DOCUMENTS

| | | | |
|---|---|---|---|
| 3,894,623 | 7/1975 | Miyawaki | 400/17 |
| 3,912,065 | 10/1975 | Kashio | 400/17 |
| 4,392,758 | 7/1983 | Bowles et al. | 400/17 |
| 4,808,016 | 2/1989 | Takahashi | 400/17 |
| 4,818,130 | 4/1989 | Harada | 400/17 |

FOREIGN PATENT DOCUMENTS

| | | | |
|---|---|---|---|
| 178582 | 11/1982 | Japan | 400/17 |
| 143989 | 7/1985 | Japan | 400/17 |
| 63-184752 | 11/1988 | Japan | 400/17 |

*Primary Examiner*—David A. Wiecking
*Assistant Examiner*—Steven S. Kelley
*Attorney, Agent, or Firm*—Oliff & Berridge

[57] ABSTRACT

In order to print well balanced underlines under a character string printed at an expanded print pitch, the disclosed printing apparatus comprises an expanded pitch setting means for setting an expanded pitch mode for providing an expanded space corresponding to a predetermined times of set print pitch between neighboring characters, and an underline print control means for controlling to print one or more underline in the expanded space between a preceding printed character and a succeeding character to be printed, when the data of the succeeding character is entered in both of the underline mode and the expanded pitch mode.

7 Claims, 15 Drawing Sheets

A E.SP B

H5

Fig. 4(a) $A$ $\uparrow H_0$

Fig. 4(b) $A^{E.SP}$ $\uparrow H_1$

Fig. 5(a) $\underline{A}^{E.SP}$ $\uparrow H_2$

Fig. 5(b) $\underline{A^{E.SP}}$ $\uparrow H_3$

Fig. 5(C) $\underline{A^{E.SP}B^{E.SP}}$ $\uparrow H_4$

Fig. 6(a) $\underline{A^{E.SP}B}$ $\uparrow H_5$

Fig. 6(b) $\underline{A^{E.SP}}$ $\uparrow H_6$

Fig. 6(C) $\underline{A}$ $\uparrow H_7$

Fig. 6(d) $\uparrow H_8$

PRINTING APPARATUS WITH EXPANDED PITCH MODE AND UNDERLINING

BACKGROUND OF THE INVENTION

The present invention relates to a printing apparatus, particularly, it relates to a printing apparatus having an expanded pitch mode and an underline mode.

In general, in the printing apparatus such as an electronic typewriter, a function for setting an auto underline mode wherein, just after printing characters and symbols, underlines are automatically printed under the characters and symbols, and a print pitch selecting function capable of selecting a print pitch between a pica pitch (10 characters/in.) and an elite pitch (12 characters/in.) are included.

Furthermore, the applicant of the present invention has proposed, in our previous application (Japanese Utility Model Pat. Application No. 75765/1987), a printing apparatus including a print pitch expanding function capable of printing at an expanded print pitch, for example, equal to doubled pitch of a selected print pitch. That is, in this printing apparatus, code data of the character or symbol and attribute data such as pitch data and underline data are stored in a line buffer in 2 bytes corresponding to the print position so that print pitches such as the "pica pitch" and "elite pitch" can be switched selectably, and an "expanded pitch" key for setting an expanded pitch mode corresponding to twice the selected print pitch is provided. When the expanded pitch mode is set, expanded pitch data are stored in the line buffer as the pitch data so as to print the character inputted successively at the expanded pitch.

In the printing apparatus, as shown in FIG. 10(*a*), when both the auto-underline mode and expanded pitch mode are set, data representing the underline are given respectively to the attribute data of entered characters "A", "B", and the characters "A" and "B" corresponding to the data inputted are printed and the underline is printed at an expanded space portion succeeding the printed characters.

According to the printing apparatus of the previous application, as shown in FIG. 10(*a*), though each underline is printed under respective printed characters "A" and "B" as well as at the expanded space portion after printing the respective characters, such a problem is encountered that the character string printed with the underline at an expanded pitch is not suitably underlined, and is unbalanced, since the last underline is printed protrudently on the right hand side of the end character of the character string printed at the expanded pitch.

In addition, since only the code data and attribute data of respective printed characters are stored in the line buffer, when the printed characters are erased as shown in FIG. 10(*b*), only the characters and their underlines are erased but the underline printed at the expanded space portion between the characters remains as it is.

SUMMARY OF THE INVENTION

The object of the present invention is to present such a printing apparatus capable of printing well balanced underlines under a character string to be printed in both of expanded pitch mode and underline mode.

The present invention relates to a printing apparatus comprising an entering means, a printing means, an underline mode setting means, a pitch setting means for setting the print pitch, an expanded pitch setting means for setting an expanded pitch mode in which an expanded space is provided between entered neighbouring characters so that the pitch between neighbouring characters become a predetermined times of the print pitch set by the pitch setting means, and an underline print control means for controlling the printing means to print one or more underlines in the expanded space between a preceding printed character and a succeeding character to be printed, when the data of the succeeding character is entered, in the case where both of the underline mode and the expanded pitch mode are set.

BRIEF DESCRIPTION OF THE DRAWINGS

The preferred embodiment of the present invention will now be described with reference to the following drawings in which.

PREFERRED EMBODIMENT

Hereinafter, a preferred embodiment of the present invention will be described with reference to the drawings.

The embodiment shows one example where the present invention is applied to an electronic typewriter.

Figure 1:
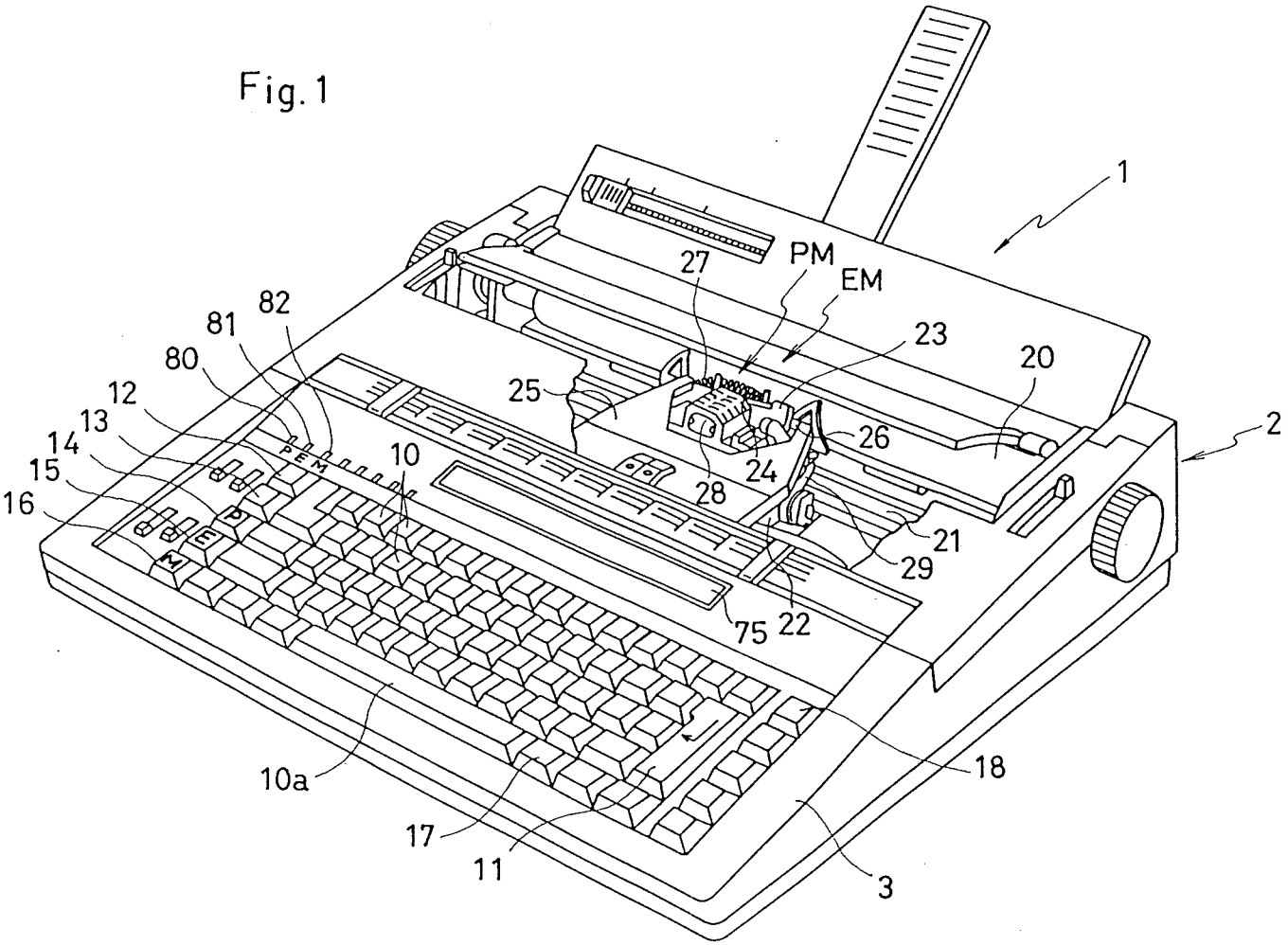
FIG. 1 is a perspective view of an electronic typewriter.

As shown in FIG. 1, in front of a frame 2 of the electronic typewriter 1, there is provided a keyboard 3, behind which a printing mechanism PM and an erasing mechanism EP are disposed on the frame 2, and a one-line liquid crystal 75 for displaying entered characters, symbols etc. is installed.

On the key board 3, as same as the ordinary typewriter, character keys 10 (printable keys) including alphabet keys, numeral keys and symbol keys, a return key 11, an auto-underline key 12 for setting or releasing an auto-underline mode, an expanded pitch key 13 for setting or releasing an expanded pitch mode which expands the print pitch in the spacing direction of characters to be printed as twice the print pitch which is selected and set at present, a pica pitch key 14 for setting the pica pitch, an elite pitch key 15 for setting the elite pitch, a micron pitch key 16 for setting the micron pitch, a correction key 17 for inputting an erasing command of the printing character, a back-space key 18 and various function keys are provided.

Moreover, on the keyboard 3, a pica pitch lamp 80 which lights when the pica pitch is set, an elite pitch lamp 81 which lights when the elite pitch is set, and a micron pitch lamp 82 which lights when the micron pitch is set are arranged.

The printing mechanism PM which is similar to that of the ordinary electronic typewriter comprises, at least, a platen 20 for feeding print paper and its driving motor and a driving circuit, a carriage 22 supported by a guide 21 in parallel to the platen 20 and a motor for driving the carriage 22 reciprocatively in both directions and its driving circuit, a typewheel 24 contained in a wheel cassette 23 and its driving motor and a driving circuit, a print ribbon 26 contained in a ribbon cassette 25 and its winding motor and a driving circuit, and a print hammer for hammering the type elements 27 of the type wheel 24 and its driving solenoid 28 and a driving circuit.

The erasing mechanism EM comprises a correcting ribbon 29 which erases the printed character by lifting off ink, a ribbon switching mechanism which switches the correcting ribbon 29 to the lifted position in place of the print ribbon 26 at erasing operation, and a winding mechanism which winds the correcting ribbon 29 responsive to the operation of the ribbon switching mechanism.

Figure 2:
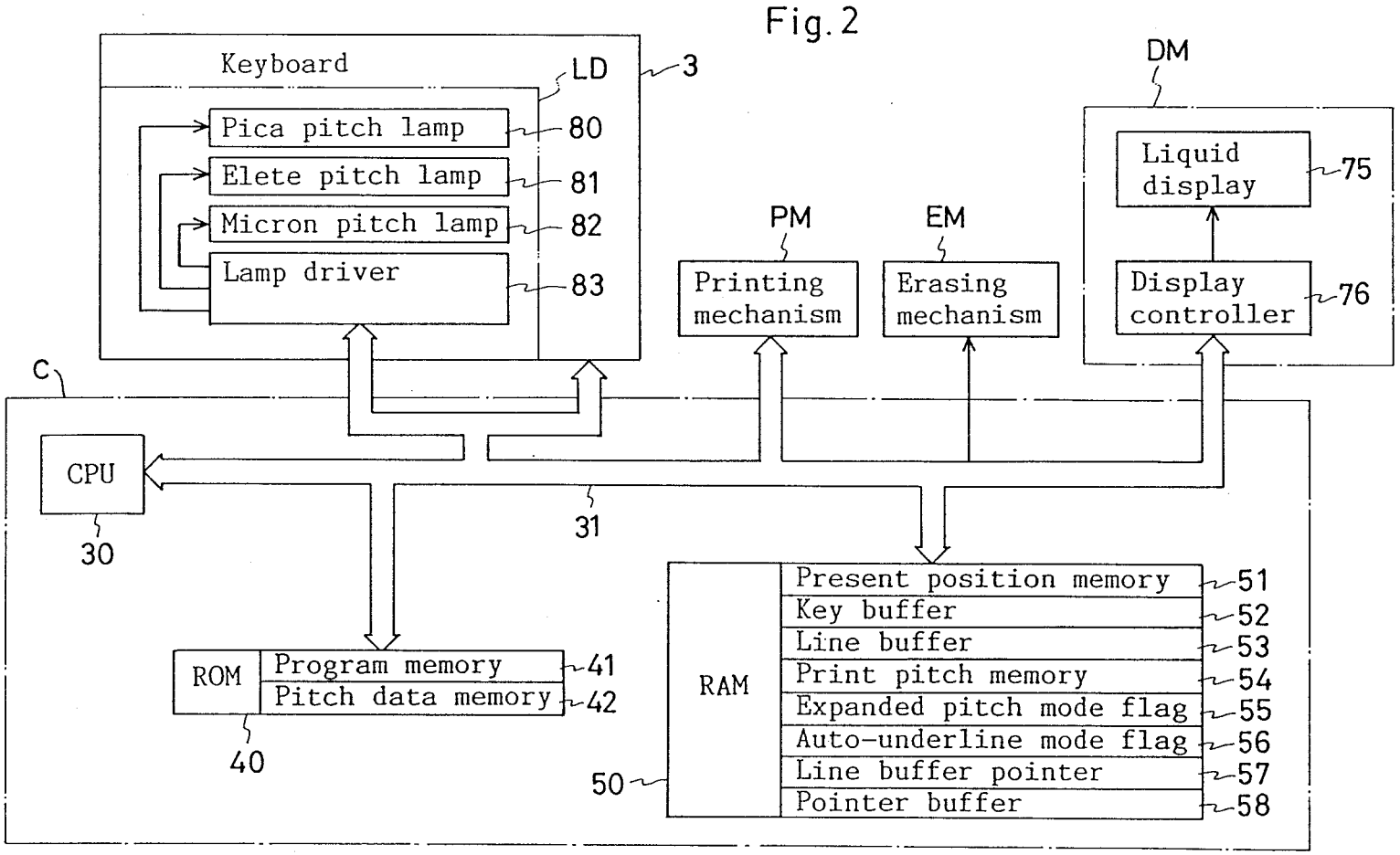
FIG. 2 is a block diagram of a control system of the typewriter, FIGS. 3(*a*)~3(*g*) are flow charts showing a routine of underline print control, FIGS. 4(*a*) and 4(*b*) are explanatory views for explaining respectively the underline print control when an expanded pitch mode is set, FIG. 5(*a*)~5(*c*) are explanatory views for explaining respectively the underline print control when both an expanded pitch mode and an underline mode are set, FIGS. 6(*a*)~6(*d*) are explanatory views for explaining respectively the erasure of a printed character string in an expanded pitch mode and an underline mode, FIG. 7(*a*)~7(*c*) are flow charts of a routine of an underline print control routine of another embodiment, FIGS. 8(*a*)~8(*c*) are views equivalent to FIG. 6(*a*)~6(*d*) in another embodiment, FIGS. 9(*a*)~9(*f*) are views equivalent to FIG. 6(*a*)~6(*d*) in another embodiment, and FIGS. 10(*a*) and 10(*b*) are explanatory views for explaining respectively the underline print control and erasing control according to the prior art in the case where both an expanded pitch mode and an underline mode are set.

Now, the entire configuration of a control system of the electronic typewriter 1 will be described with reference to a block diagram of FIG. 2.

The electronic typewriter 1 comprises in principle the keyboard 3, the printing mechanism PM, the erasing mechanism EM, a displaying mechanism DM and a controller C and so on, which are connected to a CPU 30 of the controller C via a bus 31 including a data bus etc. The controller C comprises the CPU30, ROM(-Read Only Memory) 40 and a RAM(Random Access Memory) 50 which are connected to the CPU30 via the bus 31.

A program memory 41 of the ROM 40, stores control programs for controlling the printing mechanism PM, erasing mechanism EM and displaying mechanism DM responsive to code data inputted from respective character keys 10 and various function keys on the keyboard 3, and control programs of an underline print control to be described later. A pitch data memory 42 of the ROM 40 stores print pitch data corresponding to respective pitches of pica pitch, elite pitch and micron pitch.

The RAM 50 stores a present position memory 51 for storing the present position of the carriage 22 from the absolute origin as renewing sequentially, a key buffer 52 for storing input data from the keyboard 3 temporarily, a line buffer 53 for storing data for 500 characters corresponding to each print position by storing input data transferred sequentially from the key buffer 52 in one byte, and by storing print pitch data (shifting amount of carriage) and attribute data such as underline, bold, superscript and subscript data in one byte, a print buffer for receiving and storing data transferred from the line buffer 53 so as to be printed by the printing mechanism PM, a print pitch memory 54 for reading out pitch data of the print pitch in the spacing direction selected at present from the pitch data memory 42 to store it, an expanded pitch mode flag 55 which is set when the expanded pitch mode is set, an auto-underline mode flag 56 which is set when the auto-underline mode is set, a line buffer pointer 57 for indicating an address of the line buffer 53 corresponding to the data of the present position memory 51, a pointer buffer 58 for storing data of the line buffer pointer 57 temporarily and a plurality of memories for storing the results processed in the CPU30.

A lamp display unit LD comprises a pica pitch lamp 80, an elite pitch lamp 81, a micron pitch lamp 82 and a lamp driver 83 which drives respective lamps and is connected to the CPU30 through the data bus31.

A display mechanism DM similar to an ordinary one comprises a liquid crystal display 75 and a display controller 76 for outputting the drive signal to the display 75.

Figure 3:
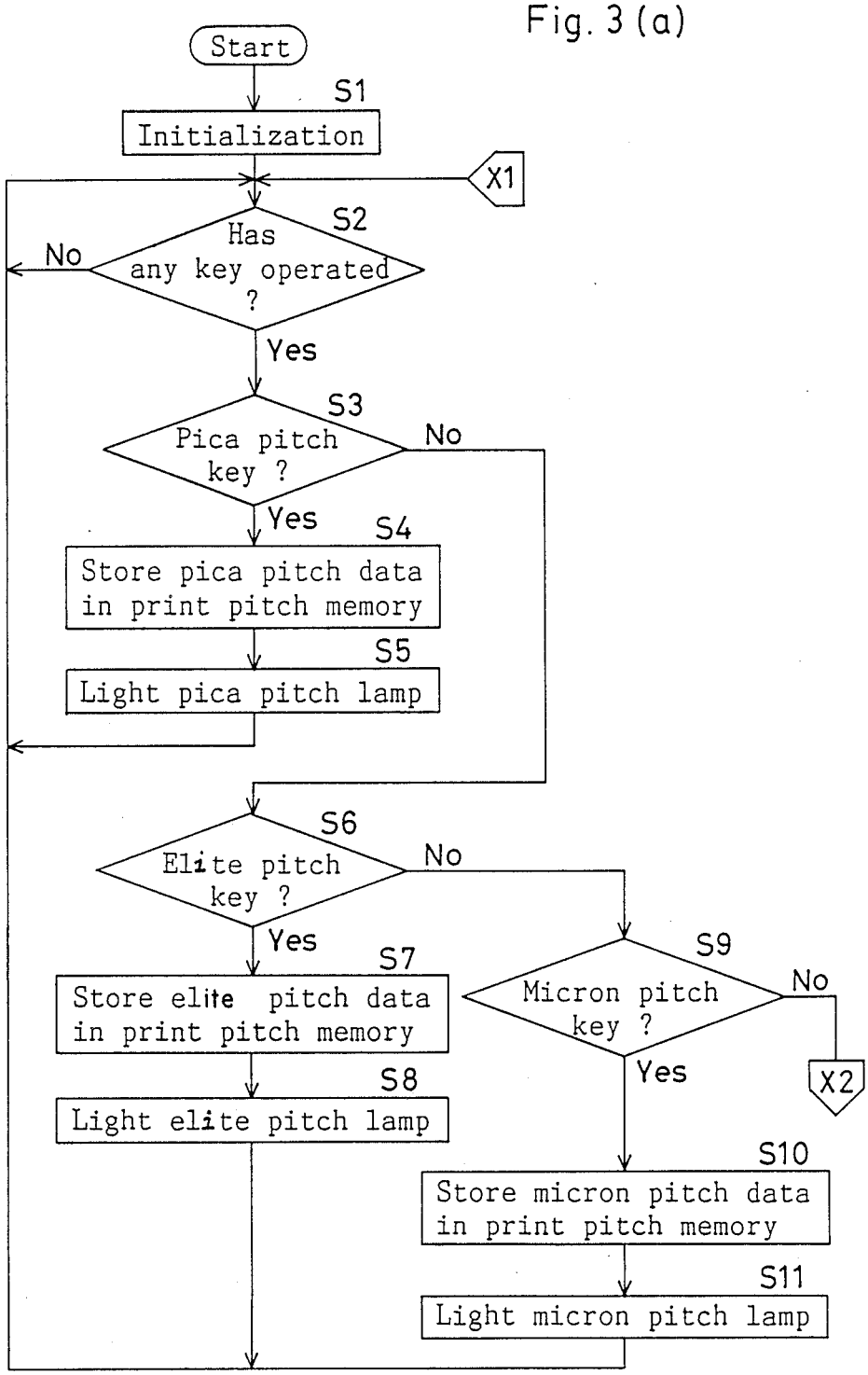
Figure 3:
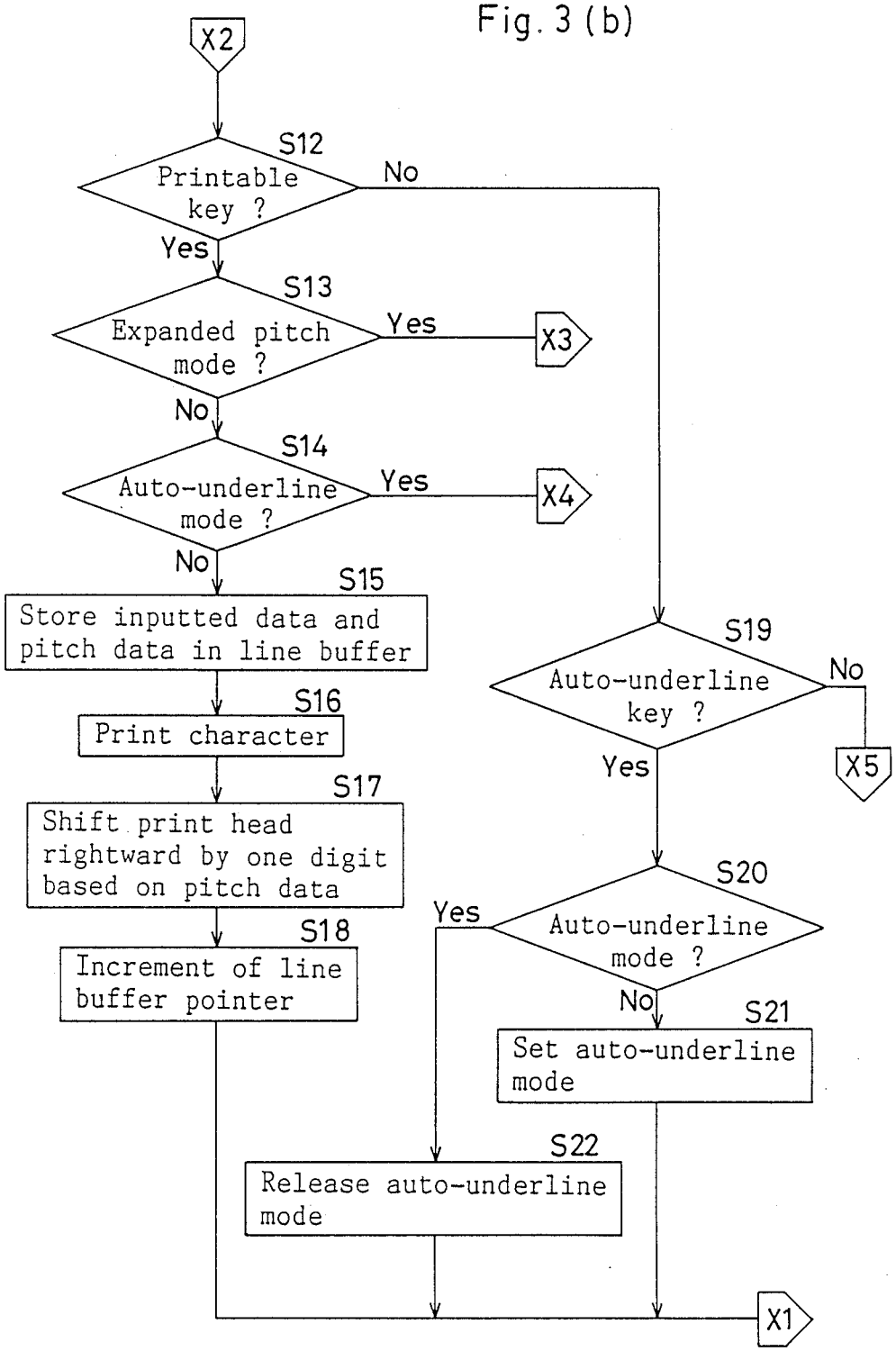
Figure 3:
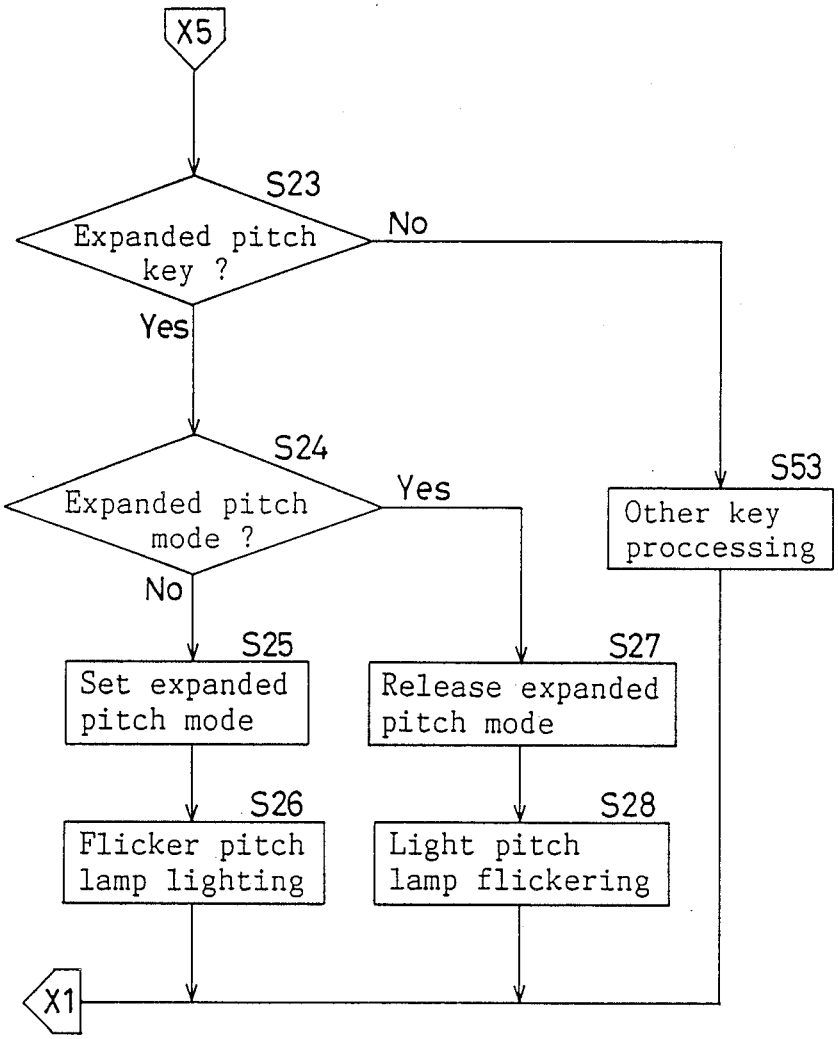
Figure 3:
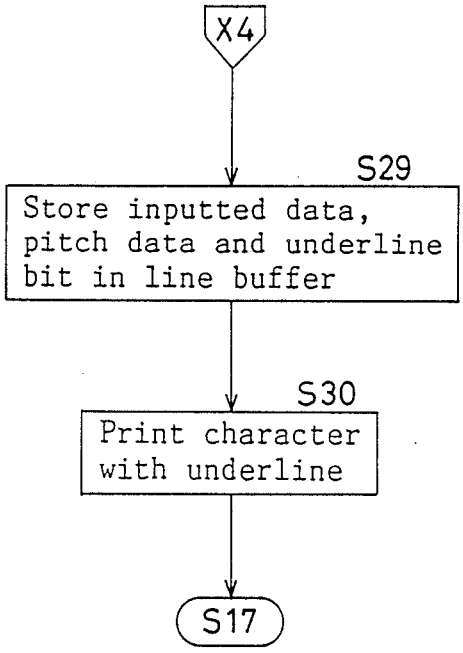
Figure 3E:
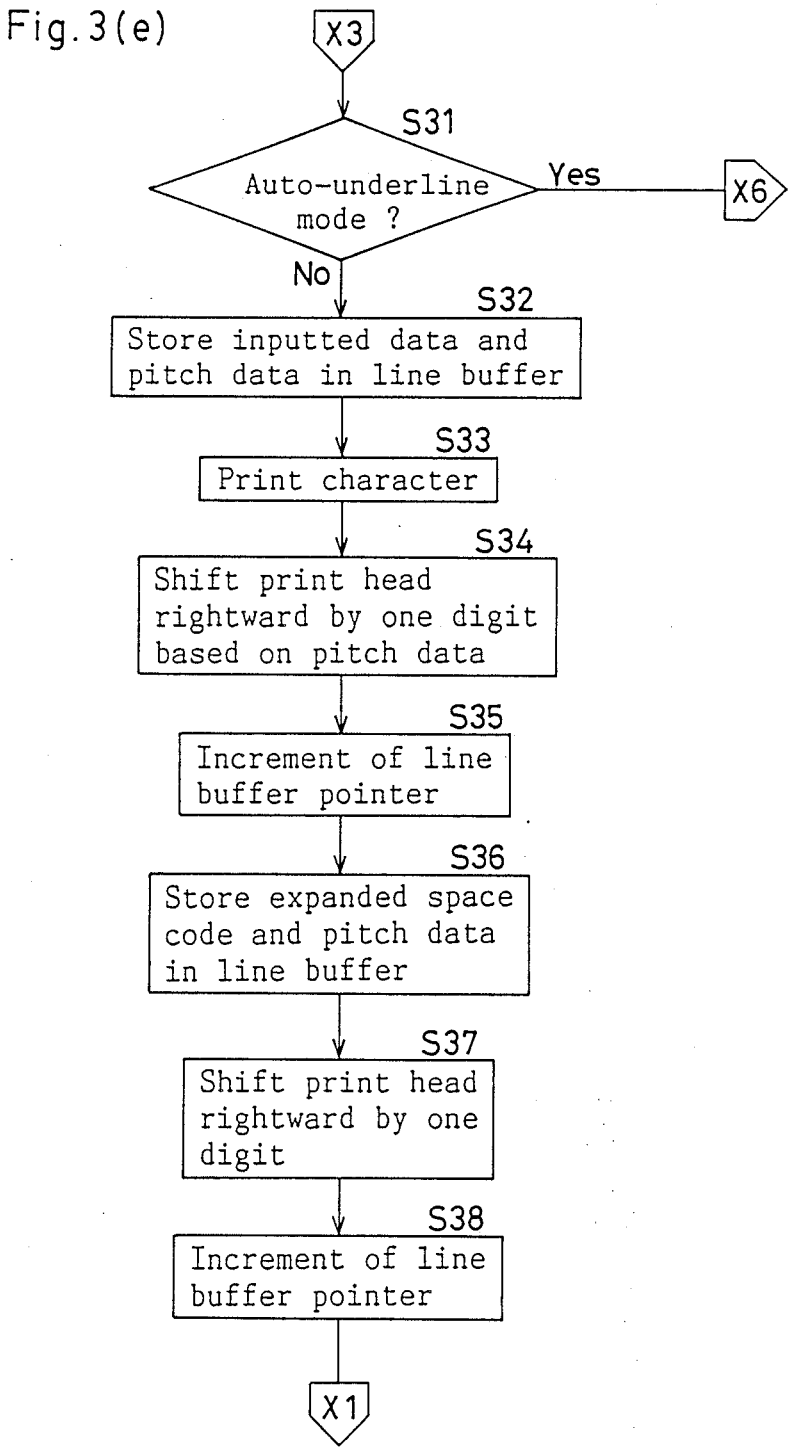
Figure 3:
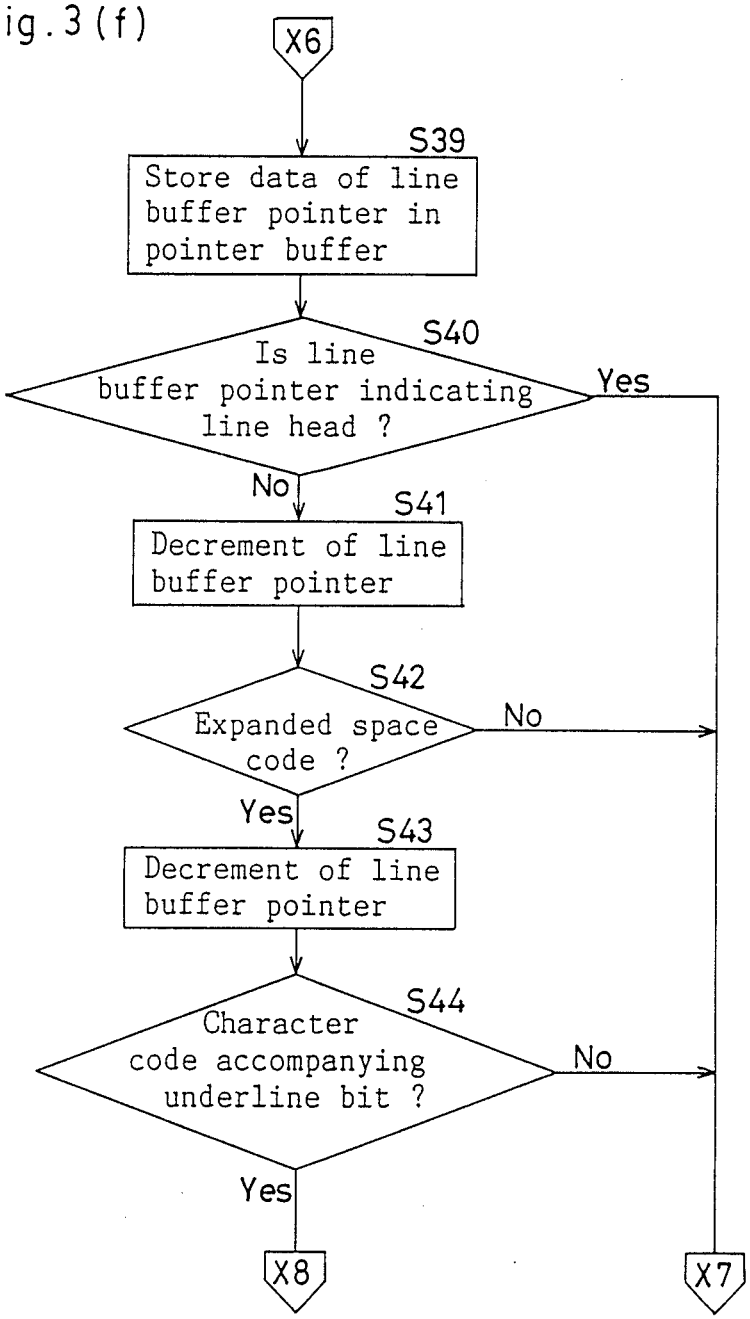
Figure 3:
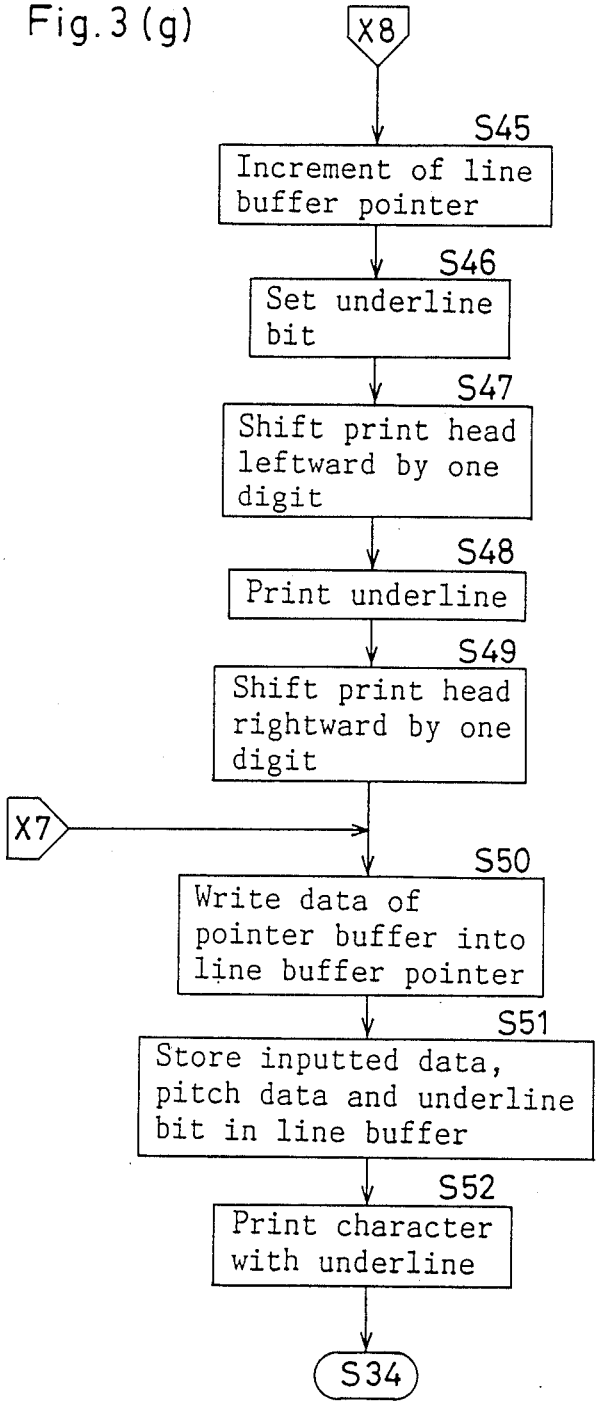

Next, the underline print control performed by the controller C of the electronic typewriter 1 will be described with reference to flow charts of FIGS. 3(*a*)~3(*g*). The print pitch setting control for setting the print pitch, the underline mode setting control for setting an auto-underline mode and the expanded pitch mode setting control for setting an expanded pitch mode will be also described.

When the typewriter 1 is energized, the control is effected and initialized in Step S1 to reset respective flags and to clear respective memories and pointers. When the pica pitch key 14 is operated (Step S3), pica pitch data are read from the pitch data memory 42 and stored in the print pitch memory 54 (Step S4), and then the pica pitch lamp 80 is lit and the other lamps 81, 82 are turned off (Step S5), then processing returns to Step S2.

When the elite pitch key 15 is operated (Step S6), elite pitch data are read from the pitch data memory 42 and stored in the print pitch memory 54 (Step S7), and then the elite pitch lamp 81 is lit and the other lamps 80, 82 are turned off (Step S5), then processing returns to Step S2.

When the micron pitch key 16 is operated (Step S9), micron pitch data are read from the pitch data memory 42 and stored in the print pitch memory 54 (Step S10), and then the micron pitch lamp 82 is lit and the other lamps 80, 81 are turned off (Step S11), then processing returns to Step S2.

When the printable keys such as character keys 10 and a space key 10a are operated (Step S12) in neither the expanded pitch mode indicated by flag data of the expanded pitch mode flag 55 nor the auto-underline mode indicated by the auto-underline mode flag 56 (Steps S13, S14), input data (code data) and attribute data such as pitch data and underlining data being set are stored in an address of the line buffer 53 indicated by the line buffer pointer 57 (Step S15). Furthermore, the data stored in the line buffer 53 and indicated by the line buffer pointer 57 are transferred to the print buffer, then the character corresponding to the code data is printed (Step S16), and next the carriage 22 with the print head is shifted rightward by one digit in response to the print pitch data (Step S17) and the line buffer pointer 57 is stepped incrementally (Step S18), then processing returns to Step S2.

When the auto-underline key 12 is operated (Step S19), if the auto-underline mode is not set (Step S20), the auto-underline mode flag 56 is set for setting the auto-underline mode (Step S21), then processing returns to Step S2. However, when the auto-underline mode is set, the auto-underline mode flag 56 is reset for releasing the auto-underline mode (Step S22), then processing returns to Step S2.

When the expanded pitch key 13 is operated (Step S23), if the expanded pitch mode is not set (Step S24), the expanded pitch mode flag 55 is set for setting the expanded pitch mode (Step S25), and one of the pitch lamps 80~82 being lit is flickered to show the operator that the expanded pitch mode is set (Step S26), then processing returns to Step S2. However, when the expanded pitch mode is set, the expanded pitch mode flag 55 is reset for releasing the expanded pitch mode (Step S27), and the flickering lamp among pitch lamps 80~82 is lit (Step S28), then processing returns to Step S2.

When the printable keys are operated (Step S12), if the expanded pitch mode is not set and the auto-underline mode is set (Steps S13, S14), the inputted code data and the pitch data from the print pitch memory 54 are stored in the address of the line buffer 53 indicated by the line buffer pointer 57 with setting the underline bit (Step S29), and then the character corresponding to the code data is printed with the underline (Step S30), and the Steps S17~S18 are executed, then processing returns to Step 2.

On the contrary, when the printable keys are operated (Step S12), if only the expanded pitch mode is set (Step S13, S31), the inputted code data and pitch data based upon the data in the print pitch memory 54 are stored in the address of the line buffer 53 indicated by the line buffer pointer 57 (Step S32). Furthermore, the data stored in the line buffer 53 and indicated by the line buffer pointer 57 are transferred to the print buffer, and then the character corresponding to the code data is printed (Step S33) and the print head is shifted rightward by one digit in response to the print pitch data (Step S34). For example, as shown in FIG. 4(*a*), the character "A" is printed, the print head is shifted to the print position $H_0$ and the line buffer pointer 57 indicates an address $P_0$ of the line buffer 53 corresponding to the print position $H_0$.

Then, the line buffer pointer 57 is stepped incrementally (Step S35), pitch data based upon data of the expanded space code and print pitch memory 54 are stored in the address of the line buffer 53 indicated by the line buffer pointer 57(Step S36), and next the print head is shifted rightward by one digit (Step S37), and the line buffer pointer 57 is stepped incrementally (Step S38), then processing returns to Step S2. The expanded space code is a specific space code different from a space code inputted by operating the space key 10a. For example, as shown in FIG. 4(*b*), an expanded space (E.SP) is provided succeedingly after the character "A", the print head is shifted to the print position $H_1$, and the line buffer pointer 57 indicates an address $P_1$ of the line buffer 53 corresponding to the print position $H_1$.

When the printable keys are operated (Step S12), if both the expanded pitch mode and auto-underline mode are set (Steps S13, S31), data of the line buffer pointer 57 are stored temporarily in the pointer buffer 58 (Step S39). For example, as shown in FIG. 5(*a*), when the character "A" is printed with the underline when both the aforesaid modes are set, an address $P_2$ of the line buffer 53 corresponding to the print position $H_2$ is stored in the pointer buffer 58 by the line buffer pointer 57.

When data of the line buffer pointer 57 are not at a line head (left margin position) (Step S40), the line buffer pointer 57 is stepped decrementally (Step S41). And when the expanded space code of the data previously inputted to the line buffer 53 indicated by the line buffer pointer 57 is stored (Step S42), the line buffer pointer 57 is stepped further decrementally (Step S43), and when the data previously inputted to the line buffer 53 indicated by the line buffer pointer 57 are stored with the underline bit (Step S44), the line buffer pointer 57 is stepped incrementally (Step S45). That is, whether or not printing of the underline is possible in the print position corresponding to the expanded space code of the data previously inputted in Steps S42 and S44 is determined.

Then, the underline bit in an attribute data corresponding to the expanded space code of the data previously inputted and indicated by the line buffer pointer 57 is set (Step S46), and then the print head is shifted leftward by one digit (Step S47) and the underline is printed (Step S48). For example, as shown in FIG. 5(*b*), the underline is printed when the print head is in the position $H_3$.

Moreover, the print head is shifted rightward by one digit (Steps S49), data of the pointer buffer 58 are written in the line buffer pointer 57 (Step S50). Then, input data, pitch data based upon data of the print pitch memory 54 and underline bit are stored in the address of the line buffer 53 indicated by the line buffer pointer 57 (Step S51), and next the character corresponding to code data of the inputted data is printed with the underline (Step S52) and Steps S34~S38 are executed, then processing returns to Step S2. For example, as shown in FIG. 5(*c*), the character "B" is printed with the underline, the print head is shifted to $H_4$ and an address $P_4$ of the line buffer 53 corresponding to the print position $H_4$ is stored in the line buffer pointer 57.

When keys other than the printable keys such as the character key 10, pica pitch key 14, elite pitch key 15, micron pitch key 16, auto-underline key 12 and expanded pitch key 13 are operated, the other key processings corresponding to the operated keys are executed (Step S53), then processing returns to Step S2.

As described hereinabove, when the expanded pitch mode is set, expanded spaces twice the print pitch set are provided respectively between plural inputted data, and when the succeeding character to be printed is inputted in the state where both the expanded pitch mode and underline mode are set, the input data are printed with the underline, and the underline is printed in the expanded space between the preceding character printed and the succeeding character just printed. Accordingly, the underline printed ends at the last character of a character string inputted and printed, and therefore the underline for the character string printed in the expanded pitch is well balanced. As aforementioned in the state where aforesaid two modes are set, as inputted data and the expanded space code corresponding to the expanded pitch portion are stored together with the data indicating the underline, for example, the character string with underlines shown in FIG. 5 (*c*) can be erased completely.

When the correction key 17 is operated continuously in the state shown in FIG. 5(*c*), as shown in FIG. 6(*a*), first the print head is shifted to the expanded space E.SP position $H_5$ of the character "B", and contents for 2 bytes of the line buffer 53 corresponding to the expanded space E.SP are cleared. Then, successively the print head is shifted to the print position $H_6$ shown in FIG. 6(*b*), contents of the line buffer 53 corresponding to the print position $H_6$ are cleared and the character "B" and the underline are erased. Moreover, as shown in FIG. 6(*c*), the print head is shifted to the print position $H_7$ corresponding to the expanded space of the character "A", and then contents of the line buffer 53 corresponding to the expanded space E.SP are cleared and the underline of the expanded space is erased. As shown in FIG. 6(*d*), the print head is shifted to the print position $H_8$ of the character "A", and then contents of the line buffer 53 corresponding to the print position $H_8$ are cleared and the character "A" and underline are erased.

Since data corresponding to the expanded space E.SP are stored in the line buffer 53, for example, if the backspace key 18 is operated several times when the print head is positioned at $H_4$ as shown in FIG. 5(*c*), the print head may be shifted leftward in order one digit by one digit such that, the expanded space E.SP position of the character "B" — character "B" — the expanded space E.SP position of the character "A" —···.

In the embodiment aforementioned, though the expanded pitch was designated as twice the print pitch set, it is not limited to twice, a predetermined multiple of the print pitch may be designated as the expanded pitch, or the expanded pitch may be set optionally. In this case, between respective characters of the character string, expanded spaces corresponding to a predetermined multiple or optional multiple are provided.

Furthermore, it is needless to say that he present invention may be applied in a typewriter including thermal printer, shuttle printer, wire-dot printer and laser printer.

While storing code data of the inputted data in one byte in the line buffer 53 in the state where both the expanded pitch mode and underline mode are set, attribute data and the expanded pitch as twice the pitch data set may be stored in one byte as the print pitch data to print well balanced underlines for the character string printed.

Figure 7:
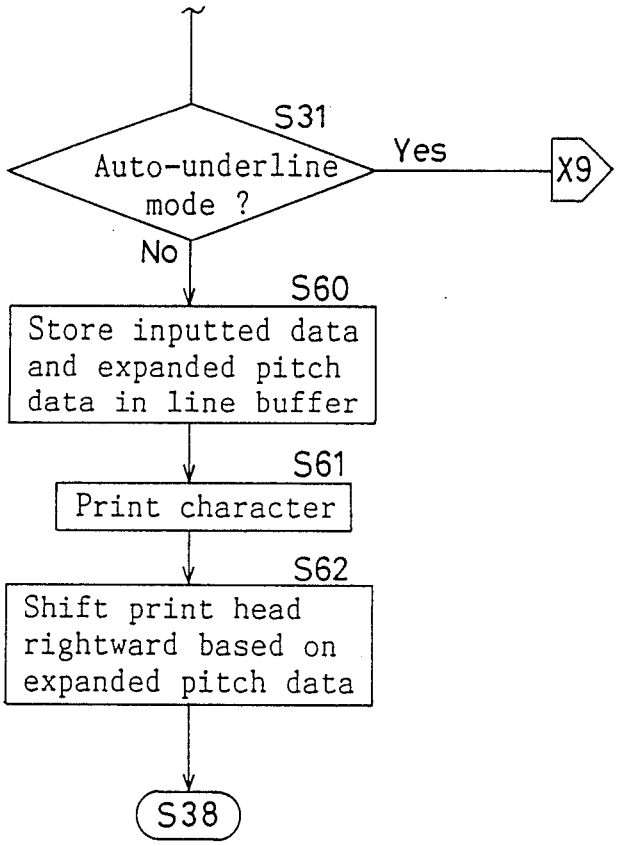
Figure 7B:
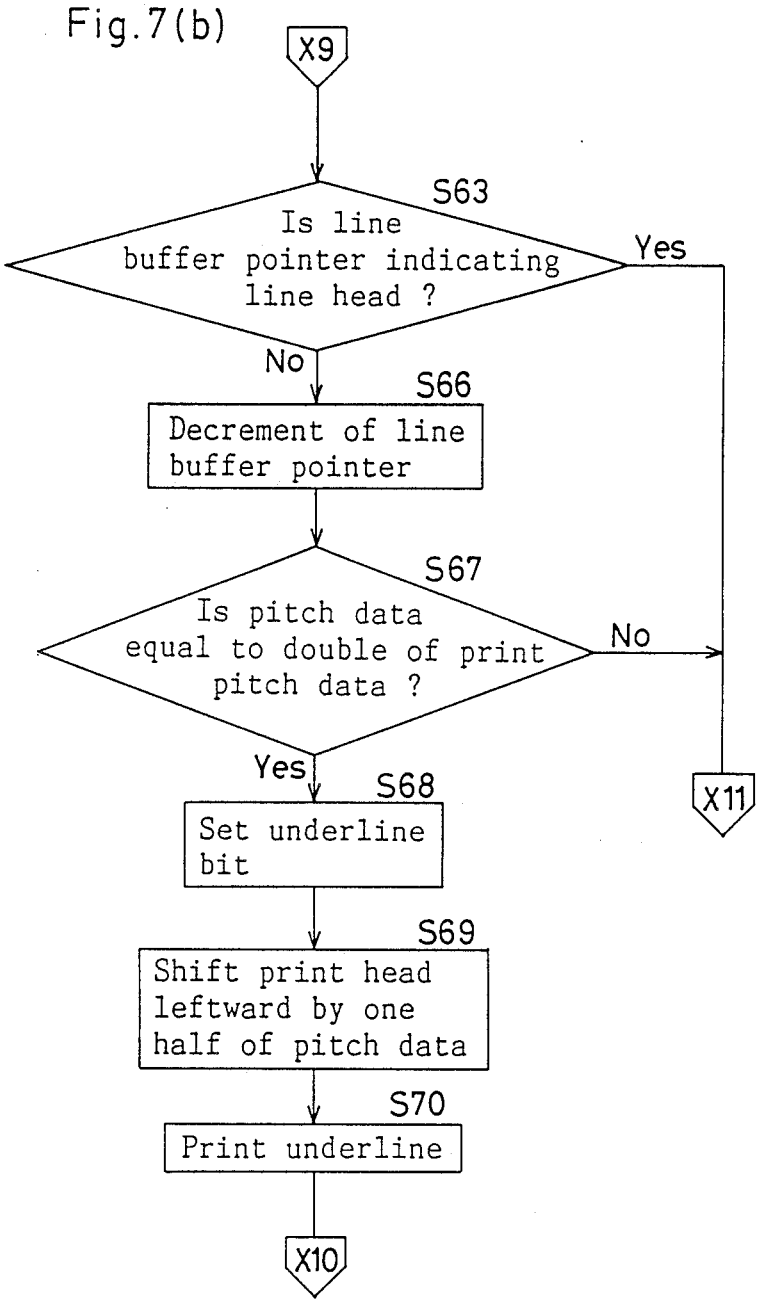
Figure 7:
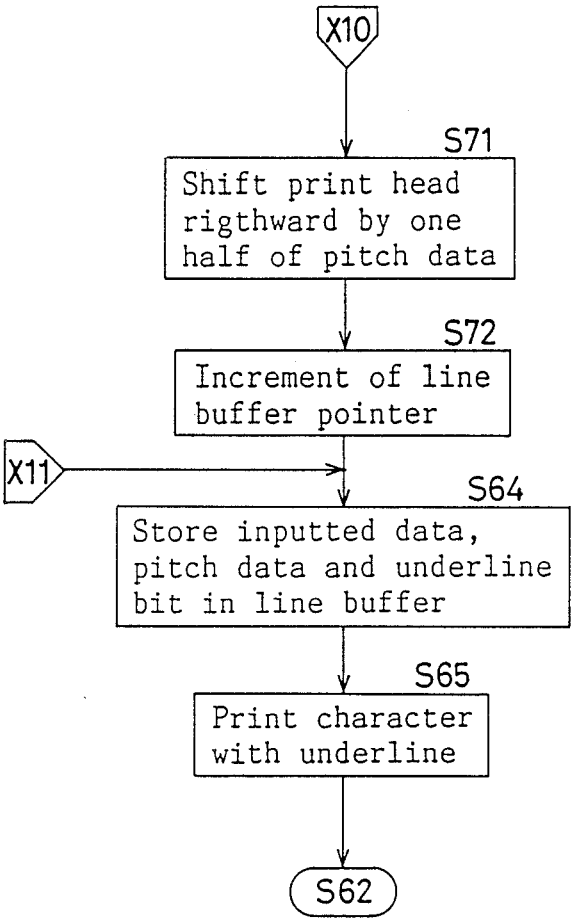

As shown in FIG. 7, the underline print control routine in the aforesaid embodiment may be partly modified by replacing Steps S32~S37 and Steps S39~S52 respectively with Steps S60~S62 and Steps S62~S69. For convenience, the case where only the expanded pitch mode is set will be described.

When the printable keys are operated (Step S12), if only the expanded pitch mode is set (Steps S13, S31), inputted data and expanded pitch data as twice the pitch data of the print pitch memory 54 are stored in the address of the line buffer 53 indicated by the line buffer pointer 57 (Step S60). Data stored in the line buffer 53 and indicated by the line buffer pointer 57 are printed (Step S61), and according to the print pitch data (expanded pitch data) the print head is shifted rightward (Step S62), and then processing moves to Step S38.

When the printable keys are operated (Step S12), if both the expanded pitch mode and auto-underline mode are set (Steps S13, S31) and data of the line buffer pointer 57 are in the line head position (Step S63), input data, expanded pitch data as twice the data of the print pitch memory 54 and underline bit are stored in the address of the line buffer indicated by the line buffer pointer 57 (Step S64), and the character corresponding to code data of the inputted data is printed with underline (Step S65) and Steps S62, S38 are executed, then processing returns to Step S2. For example, as shown in FIG. 8(*a*), the character "A" inputted is printed with underline and the print head is shifted to the position $H_9$ by the expanded pitch.

Next, when the printable keys are operated (Steps S12, S13, S31), since data of the line buffer pointer 57 are not in the line head position (Step S63), the line buffer pointer 57 is stepped decrementally (Step S66), and when the pitch data of the data inputted previously in the line buffer 53 indicated by the line buffer pointer 57 is the expanded pitch which is twice the data of print pitch memory 54 (Step S67), underline bit in attribute data corresponding to the data previously inputted of the line buffer 53 indicated by the line buffer pointer 57 are set (Step S68), and then the print head is shifted leftward by one half of the pitch data (expanded pitch) (Step S69), and the underline is printed (Step S70). For example, the underline is printed in the position $H_{10}$ shown in FIG. 8(*b*).

Thereafter, the print head is shifted further rightward by one half of the pitch data (Step S71), the line buffer pointer 57 is stepped incrementally (Step S72) and succeeding steps including Step S64 onward are executed to print the character corresponding to code data of the inputted data with underlines. For example, as shown in FIG. 8 (*c*), the underlines are printed from the characters "A" to "B" and the print head is shifted to $H_{11}$.

Figure 8A:
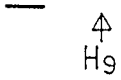
Figure 8B:
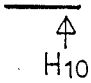
Figure 8C:
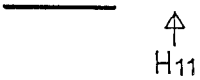
Figure 9A:
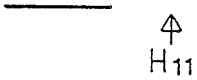
Figure 9B:
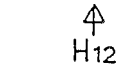
Figure 9C:
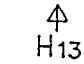
Figure 9D:
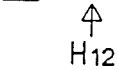
Figure 9E:
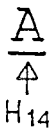
Figure 9F:
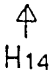
Figure 10A:
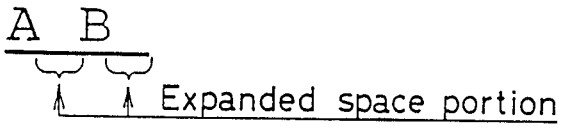
Figure 10B:
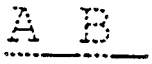

Moreover, it is possible to erase all the character string with underlines shown in FIG. 8 (*c*).

That is, when the correction key 17 is operated continuously in FIG. 9 (*a*) according to the embodiment aforementioned, the character data before the present position are read out, and in response to its pitch data, as shown in FIG. 9(*b*), the print head is shifted to the print position $H_{12}$ of the character "B", which is erased together with its underline. At this time, in response to data of the line buffer 53, when data indicating the expanded pitch and underline mode are given to the character "A" inputted immediately before the character now erased, the print head is shifted leftward by one half of the expanded pitch (refer to FIG. 9(*c*)) and shifted rightward after erasure of the underline (refer to FIG. 9 (*d*)). Then the print head is shifted to the print position $H_{14}$ the character "A" in response to data of the line buffer 53 (refer to FIG. 9(*e*)) to erase the character "A" (refer to FIG. 9(*f*)).

Also in this case, wherever the characters are erased, data corresponding to the characters erased are deleted from the line buffer 53.

In the printing apparatus according to the present invention, in the state where both the underline mode and expanded pitch mode are set, printing means is controlled by underline print control means such that, when the succeeding character to be printed is inputted by inputting means, the underline is printed in the expanded space between the preceding character printed and the succeeding character to be printed.

In such a manner, when both the underline mode and expanded pitch mode are set, though the expanded space is provided for the character inputted and printed, the underline is not printed in the expanded space successively, but printed when the succeeding character to be printed is inputted.

According to the printing apparatus of the present invention, in the state where both the underline mode and expanded pitch mode are set, when the succeeding character to be printed is inputted, it is so controlled that the underline is printed in the expanded space between the preceding character printed and the succeeding character to be printed, so that the underline is printed from the first character of the character string printed in the expanded pitch, and ends at the end character of the character string. Thereby, protrusion of the underline rightward of the end character of the character string printed in the expanded pitch is eliminated and the well balanced printing can be accomplished.

What is claimed is:

1. A printing apparatus comprising;

an entering means for entering data of characters and various command signals, a line buffer for storing data entered from said entering means, a printing means for printing characters along a print line corresponding to data entered into said line buffer on a printing medium, an underline mode setting means for setting an underline mode in which said characters are printed with underlines, a pitch setting means for setting one of plural print pitches, an expanded pitch setting means for setting an expanded pitch mode in which an expanded space is provided between entered neighboring characters in said print line so that the pitch between neighboring characters is an integer multiple greater than 1 of said print pitch set by said pitch setting means, and an underline print control means for controlling said printing means to print one or more underlines in said expanded space between a preceding printed characters and a succeeding character to be printed before printing of said succeeding character when the data of said succeeding character is entered, when both said underline mode and said expanded pitch mode are set.

2. A printing apparatus according to claim 1; wherein said line buffer has a line buffer pointer means for pointing to an address where an expanded space code is stored dependently on entered data of a character, when said expanded pitch mode is set.

3. A printing apparatus according to claim 1; wherein said expanded pitch setting means comprises an expanded pitch mode flag and means for setting the flag when said expanded pitch mode is set.

4. A printing apparatus according to claim 1; wherein said underline print control means further comprises a control means for controlling said printing means so that, when the data of said succeeding character is entered, said printing means prints said one or more underlines in said expanded space after backspacing the print head along said print line and then prints said succeeding character with its underline after spacing the print head.

5. A printing apparatus according to claim 1; wherein said underline print control means further comprises a control means for controlling said printing means so that said printing means holds the print head at the print position of said preceding character until the data of said succeeding character is entered and when said data is entered, said printing means prints said one or more underlines in said expanded space after spacing the print head along said print line and then prints said succeeding character with its underline after spacing the print head.

6. A printing apparatus according to claim 1; said printing apparatus further comprising an erasing means for erasing each printed character, its underline and said one or more underlines in said expanded space according to data in said line buffer.

7. A printing apparatus comprising:

an entering means for entering data of characters and various command signals;

an underline mode setting means for setting an underline mode in which said characters are printed with an underline respectively, a pitch setting means for setting one of a plurality of print pitches;

an expanded pitch setting means for setting an expanded pitch mode in which an expanded space is provided at a print position in a print line following respective printed characters so that the pitch between neighboring printed characters is an integer multiple greater than 1 of said print pitch set by said pitch setting means, a line buffer for storing data of said characters entered from said entering means, expanded space codes each of which is dependent on data of said character respectively which is entered under said expanded pitch mode, and underline bit data each of which is dependent on data of said character respectively which is entered under said underline mode;

a printing means for printing characters along said print line and underlines corresponding to data stored in said line buffer on a printing medium, a judging means for judging whether or not a preceding most newly printed character is printed with said underline and said expanded space code, based on data stored in said line buffer, and an underline print control means for controlling said printing means to print one or more underlines in said expanded space between said preceding most newly printed character and a succeeding character to be printed in said print line, in accordance with an affirmative judging result of said judging means, when the data of said succeeding character is entered, and before said succeeding character is printed.

* * * * *